United States Patent [19]

MacDonald

[11] 3,965,950

[45] June 29, 1976

[54] FASTENER DRIVER AND FASTENER HOLDING NOSEPIECE

[76] Inventor: Murdo A. MacDonald, 600 Ridge Road, Bloomfield Hills, Mich. 48013

[22] Filed: Mar. 20, 1975

[21] Appl. No.: 560,360

[52] U.S. Cl. ..... 145/52; 144/32 R

[51] Int. Cl.[2] ..... B25B 15/00; B25B 23/10

[58] Field of Search ..... 145/52; 144/32

[56] References Cited

UNITED STATES PATENTS

| | | | |
|---|---|---|---|
| 637,990 | 11/1899 | Hoepner | 145/52 |
| 1,383,429 | 7/1921 | Russell | 145/52 |
| 2,205,167 | 6/1940 | Greterman | 145/52 |
| 2,444,287 | 6/1948 | Ettinger | 145/52 |
| 3,011,534 | 12/1961 | Vilmerding | 145/52 X |
| 3,012,594 | 12/1961 | Mangerian | 145/52 |
| 3,244,208 | 4/1966 | McKenzie | 145/52 |
| 3,266,537 | 8/1966 | Ulbing | 145/52 X |

*Primary Examiner*—Othell M. Simpson
*Assistant Examiner*—J. T. Zatarga
*Attorney, Agent, or Firm*—Barnes, Kisselle, Raisch & Choate

[57] ABSTRACT

Nosepiece comprises an adapter for mounting on a tool such as a power screw driver and a slide on the adapter movable parallel to the stroke of the driver. Lever-type jaws are pivoted onto the slide for holding and releasing a screw shank. Balls carried by the slide are aligned between a conical surface on the adapter and extensions of the levers to block the jaws from opening in advanced position of the slide. Upon relative retraction of the slide, the balls are aligned with a smaller diameter of the adapter so that they can shift inwardly to release the jaws for passing a screw head in either direction. Upon relief of the retracting force, the slide is returned abruptly to advanced position by a spring for closing the jaws. The conical surface, balls and lever extensions cooperate to retain the slide on the adapter against the spring force.

35 Claims, 11 Drawing Figures

FASTENER DRIVER AND FASTENER HOLDING NOSEPIECE

This invention relates generally to a power driven tool of the type having a nosepiece for holding an article such as a screw or nail having a head and a shank in alignment with a driver which drives the article against a work piece.

More particularly, the invention is concerned with an improved nosepiece for such tools. Selected for illustration of the invention is a power screw driver.

Conventional tools of the type under consideration fall generally into two categories. In one, the screw to be driven is fed to the rear of a pair of jaws aligned with the driver and biased by springs to closed condition. The point or front end of the screw is forced through the jaws until the head of the screw abuts against the rear faces of the jaws, the jaws gripping the shank of the screw. When the driver is advanced, it forces the screw forwardly causing the head to separate the jaws thereby releasing the screw so that it can be driven into the work.

In this type of tool a succession of screws is usually fed to the jaws, one at a time, from a magazine or through a pneumatic tube, or the like. This type of tool is thus inherently relatively expensive and bulky and is unsuited for use in many operations where it is desirable to load the screws into the tool by simply inserting them head first into the front of the nosepiece. Moreover, the jaws in the rear loading nosepiece must be biased together with sufficient force to prevent the screw head from separating them and escaping during the jaw-loading procedure. The magnitude of this force renders it difficult and impracticable to try to load screws head first into the front end of the jaws. If the force were diminished sufficiently to facilitate easy front loading of the jaws, they would not hold a screw satisfactorily.

In the other conventional category, the screws are loaded head first into or onto the tool, but the holding device comprises simply a magnetized bit on the driving tool. The deficiencies of this arrangement are numerous and notorious: the bits are relatively expensive and must be replaced frequently since they will not hold a screw when even slightly worn; they will not hold a screw unless clear of dirt and metal particles and thus must be cleaned frequently; the bit will not hold the screw unless the screw head is rotationally aligned so that its slotting mates with the bit; the axis of the screw must be precisely aligned with that of the screw driver to avoid loosing the screw or grinding chips off of a screw head which then requires cleaning of the bit; the bit will not hold in horizontal position a relatively long shank screw having a small diameter head; in general, magnetic bits are only suitable for use with Phillips head screws and not straight slotted screws; under optimum conditions, a screw can be knocked off of the bit or cocked on the bit if even lightly brushed against or by another object.

A third conventional category of screw driver utilizes a magnetic bit in combination with a spring-type guide which engages the outer periphery of the screw head, but this arrangement is only useful where the screw is of a special type having a circumferential flat portion against which the guide engages to provide lateral support for the screw.

A nosepiece which holds a screw by its shank has certain advantages over a nosepiece which holds a screw by its head. One advantage arises from the fact that screws are cheaply made, and their heads and shanks are seldom concentric. In a fixtured screw driver, if the head of the screw were held in correct alignment with the work, the shank of the screw would be off center and might be driven into the work improperly or not at all. A screw held by its shank is properly located, and it is immaterial that the head is slightly off center. This particular difficulty with head-held screws does not usually arise in a hand-held screw driver since the operator can properly locate the screw shank visually. However, the shank-held screw in a hand tool is advantageous in that the screw is provided with sufficient lateral support to facilitate its use as a drift pin to lever two slightly misaligned holes into full registry for receiving the screw.

The object of the present invention is to provide a front loading nosepiece structure which holds the screw by its shank, which is relatively simple and inexpensive, quick and convenient to use and which is improved to eliminate the deficiencies of conventional front loading-type screw drivers. One form of the invention is shown in the accompanying drawings.

FIGS. 6—11 are enlarged scale sectional views illustrating successive steps in loading a screw into the nosepiece and driving the screw into a work.

Figure 1:
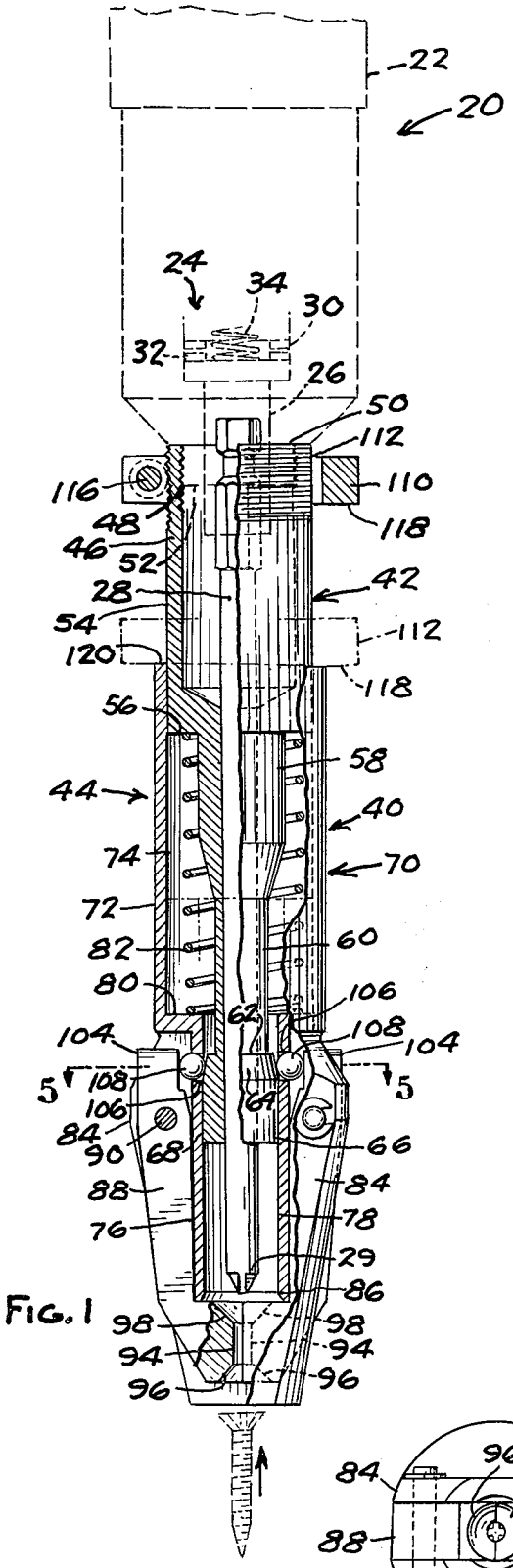
FIG. 1 is a view partly in elevation and partly in section illustrating a nosepiece according to the invention mounted on a power screw driver.
Figure 2:
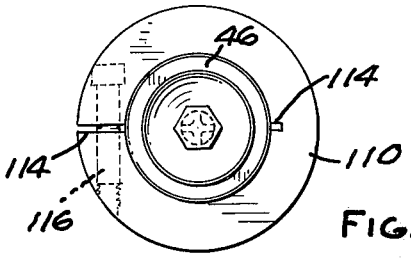
FIG. 2 is a top plan view of the nosepiece.

Shown in FIG. 1 is a conventional power screw driver 20 having a housing 22 for a motor (not shown), clutch 24 and socket attachment 26 through which a screw driver 28 is driven. Driver 28 is shown as having a bit 29 of the type for use with Phillips head screws. Clutch 24 has a driving member 30 and a driven member 32 which are held in disengaged relationship by a spring 34 except when screw driver 28 is in operation.

A nosepiece 40 according to the invention comprises generally an adapter 42 and a body 44 slidably movable on the adapter in a direction substantially parallel to the work stroke of screw driver 28. Adapter 42 has a tubular portion 46 internally threaded at 48 adjacent one end 50 for coupling with an externally threaded mounting boss 52 on housing 22. Tube 46 has a cylindrical outer surface 54 which terminates at a radially inward shoulder 56 from which the adapter continues in successive portions 58, 60 of reduced diameter, adapter portion 60 being substantially cylindrical and terminating at a radially outward shoulder 62 which adjoins an outwardly tapered conical portion 64, in turn adjoining an end portion 66 of the adapter which has a cylindrical outer surface 68.

Body 44 has generally the shape of a sleeve 70 having a larger diameter portion 72 with a cylindrical inner surface 74 slidably engaged around adapter surface 54. Sleeve 70 has a smaller diameter portion 76 having a cylindrical interior surface 78 slidably engaged around adapter surface 68. Sleeve portions 72, 76 adjoin at a radial offset forming a shoulder 80 within sleeve 72 which faces shoulder 56 on adapter 42. A coil spring 82 is compressed between shoulders 56 and 80.

Figure 3:
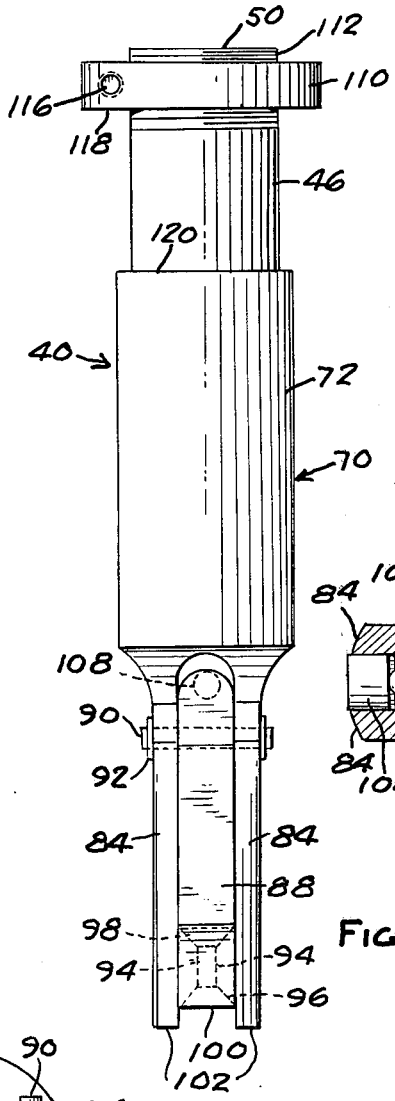
FIG. 3 is a side elevational view of the nosepiece.
Figure 5:
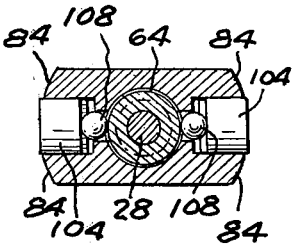
FIG. 5 is a sectional view on line 5—5 of FIG. 1.
Figure 4:
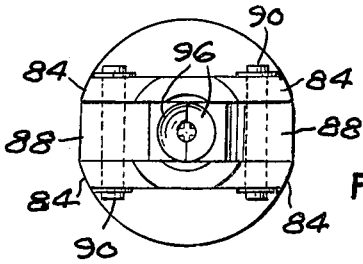
FIG. 4 is a bottom plan view of the nosepiece.
Figure 6:
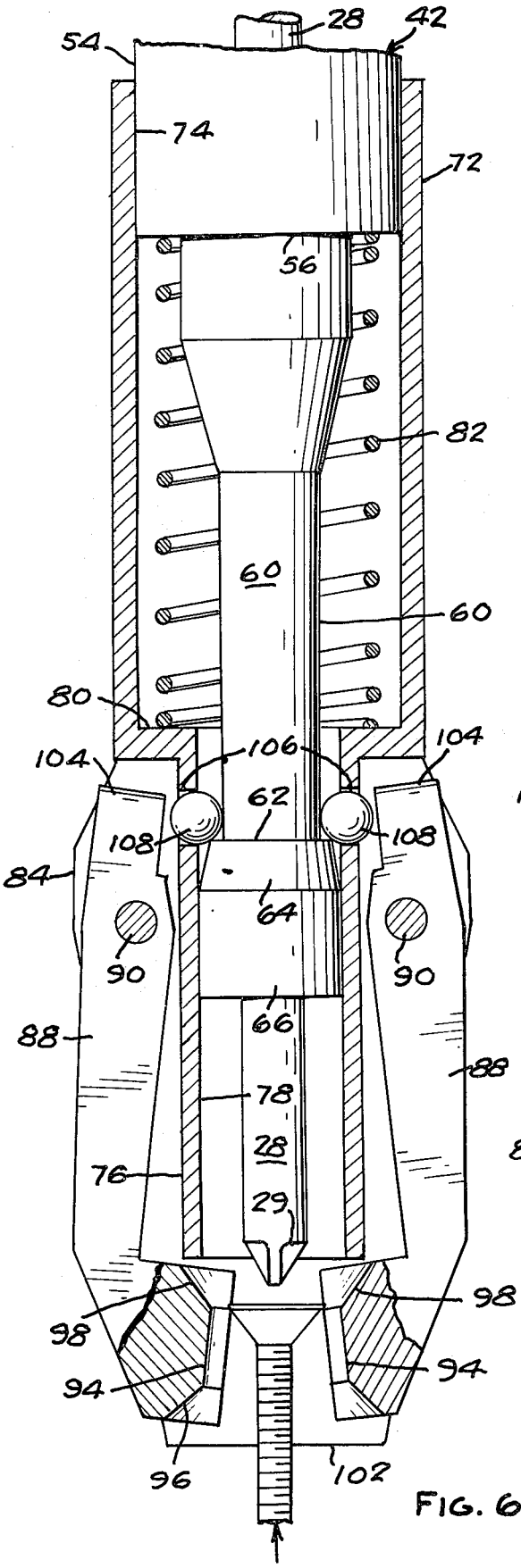

Body 44 has two pairs of lugs 84 which extend laterally outwardly from opposite sides of sleeve portion 76, and project longitudinally beyond the free end 86 of the sleeve. A lever 88 is pivotally mounted between each pair of lugs 84 by means of a pivot pin 90 which is secured in place by retaining rings 92. The free ends of levers 88 have opposed, recessed cylindrical surfaces 94 which cooperate to form jaws for gripping the shank of a screw. The ends of surfaces 94 adjoin conical surfaces 96, 98 for a purpose to be described. Surfaces 94–98 of the jaws are disposed longitudinally beyond end 86 of sleeve portion 76 as shown. Lugs 84 in turn extend longitudinally beyond the ends 100 (FIG. 3) of the jaws to provide abutment surfaces 102 for a purpose to be described.

Figure 7:
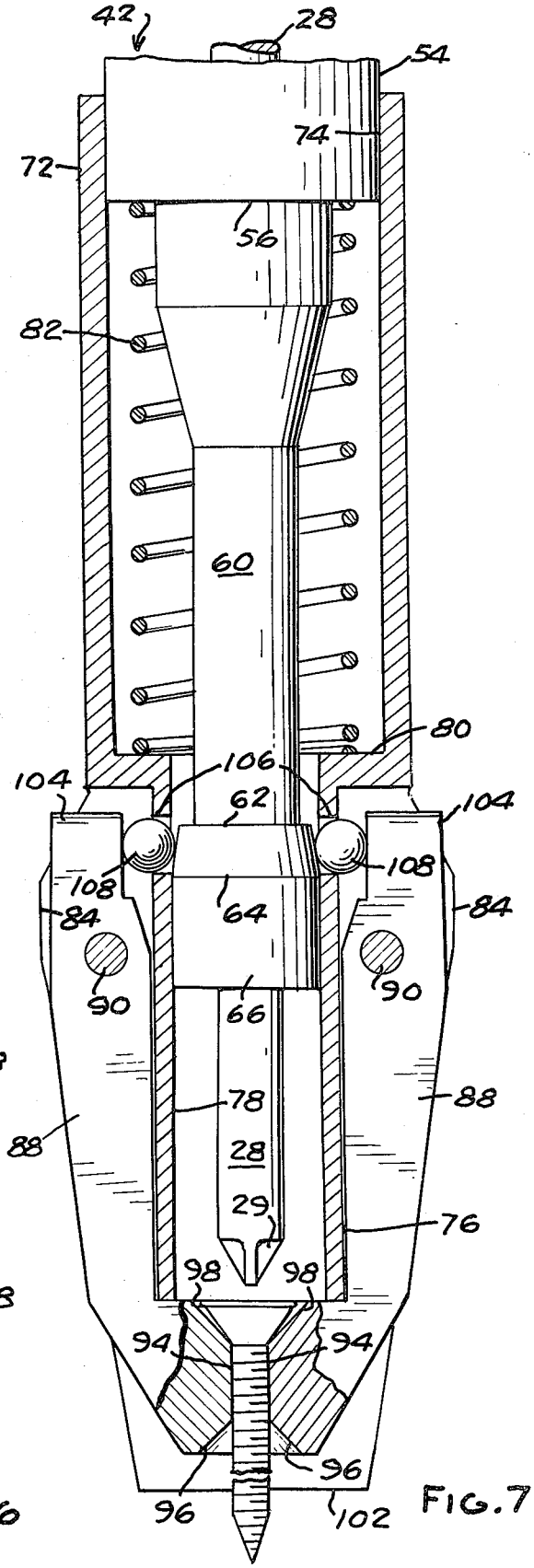
Figure 8:
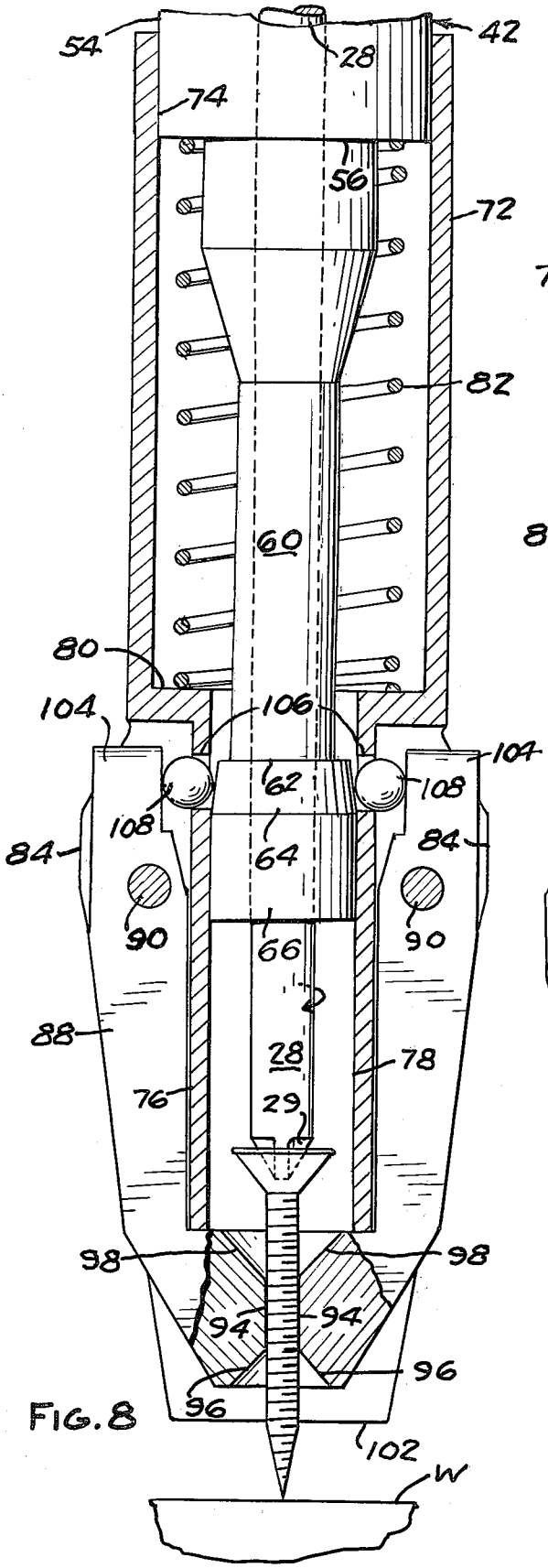
Figure 9:
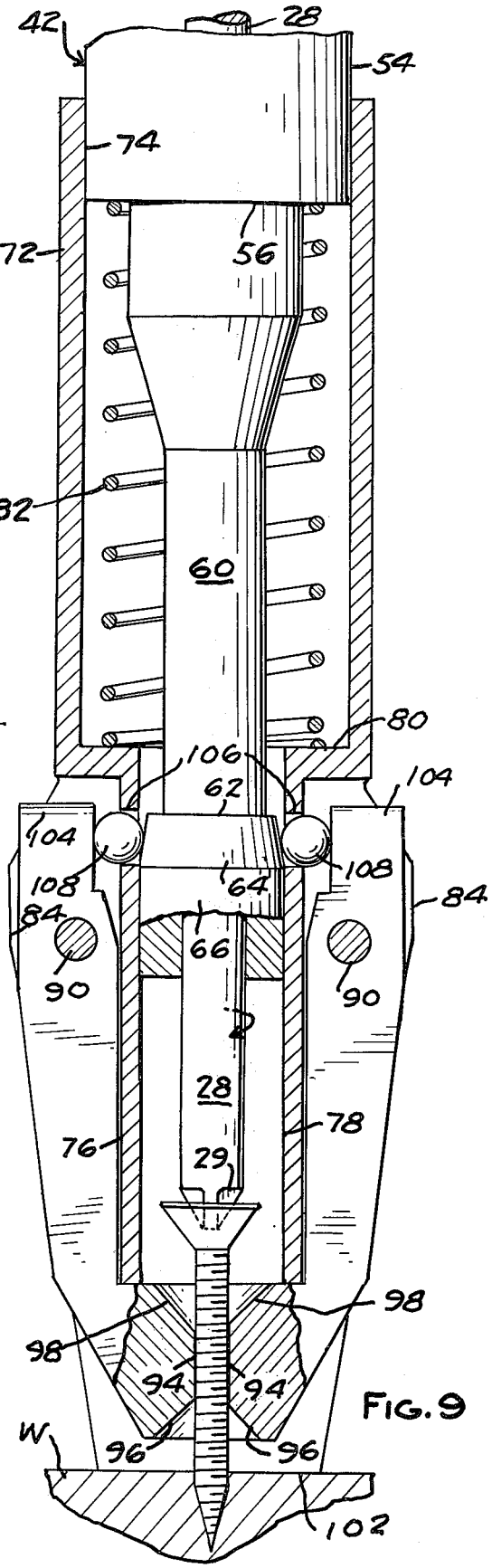

Each jaw lever 88 has an extension 104 which projects from pivot 90 in a direction opposite to the portions of the levers defining the jaws. Extensions 104 are radially aligned with conical surface 64 of adapter 42. The wall of sleeve portion 76 has openings 106 therein aligned between the conical portion and extensions. Carried radially movably within each opening 106 is a ball 108 having a diameter greater than the thickness of the sleeve wall. In the position of FIGS. 1, 7 and 9, the outer side of each ball engages the inner side of an extension 104, and the inner side of each ball engages a point on conical surface 64 which is axially spaced from both its larger and smaller diameter ends.

A collar 110 is threaded onto external threading 112 adjacent end 50 of adapter tube 46. Collar 110 has a radial split 114 bridged by a threaded cap screw 116 for tightening and loosening the collar around tube 46. Collar 110 has a radial surface 118 which faces and is engagable with a radial surface 120 at the upper end (as the drawings are viewed) of sleeve 70.

In use, it will be assumed that screw driver 20 and nosepiece 40 are at rest with the parts of the nosepiece being in the position illustrated in FIG. 1. Spring 82 urges shoulder 80 and therefore sleeve 70 downwardly as the drawing is viewed, axially thrusting balls 108 against conical surface 64 of adapter 42. Surface 64 tends to cam the balls radially outwardly but outward movement of the balls is blocked by lever extensions 104, which are prevented from swinging outwardly by interengagement of jaws 94. Since the balls cannot move outwardly, they cannot move downwardly toward the larger diameter end of surface 64, and body 44 is thus secured against detachment from adapter 42 under the bias of spring 82.

To load a screw into the nosepiece, it is first positioned with its head aligned with jaw surfaces 96 as illustrated in FIG. 1. It is then moved upwardly to push the screw head against surfaces 96 which tends to cam the jaws outwardly. However, levers 88 are blocked against outward swinging by engagement of extensions 104 against balls 108, which are obstructed from inward movement by their engagement with conical surface 64. Instead, body 44 in its entirety is shifted upwardly against the bias of spring 82, sleeve surfaces 74, 78 sliding on adapter surfaces 54, 68 respectively to facilitate this movement.

During this movement, balls 108 are carried upwardly with sleeve portion 76 until they clear shoulder 62 on adapter 42. The balls are then free to move radially inwardly toward adapter surface 60, lever extensions 108 following this movement and freeing jaws 94 to swing open. The jaws are cammed aside by the screw head and the parts are in the position represented in FIG. 6. When the screw head passes cylindrical jaw surfaces 94, the upward force of the screw head on the jaws is relieved, and spring 82 abruptly returns sleeve 70 downwardly. Balls 108 are cammed radially outwardly over shoulder 62 and over the smaller diameter portions of conical surface 64, thereby forcing extensions 104 radially outwardly and snapping jaws 94 into engagement around the shank of the screw.

The parts are now in the position illustrated in FIG. 7. Conical locking surface 64 insures that jaws 94 will become locked around the shank of a screw despite manufacturing tolerances in the elements of nosepiece 40 and manufacturing tolerances in the diameter of the screw shank. The screw is held firmly in alignment with screw driver 28, and with its point projecting axially beyond jaws 94 and beyond end surfaces 102 of lugs 84. If the screw driver is hand-held, it can be maneuvered in any direction and the point of the screw visually engaged against the proper location on the work without loosing control of the screw. Jaws 94, by their engagement around a substantial length of the screw shank, provide the screw with sufficient lateral support so that the screw point can be used as a drift pin for levering misaligned openings in the work to full registry for receiving the screw.

After the point of the screw has been engaged against the work W, the tool is pressed forwardly. Jaws 94 slide forwardly around the screw shank permitting tool 20 to advance toward the work for engaging screw driver bit 29 against the screw head. If the tool has a clutch, as shown at 24 in FIG. 1, the clutch members 30, 32 are engaged during this movement. The parts are now in the position illustrated in FIG. 8.

The motor is now actuated to rotate driver 28 which begins to drive the screw into work W. The entire tool including nosepiece 40 advances toward the work following the movement of the screw until surfaces 102 on the lead end of the nosepieces abut the work piece as shown in FIG. 9. Thereupon, movement of nosepiece body 44 is halted, but adapter 42 continues to advance thereby removing conical surface 64 from alignment between balls 108. When shoulder 62 clears the balls, they are free to move radially inwardly thereby unblocking extensions 104, levers 88 and jaws 94 for swinging movement.

Figure 11:
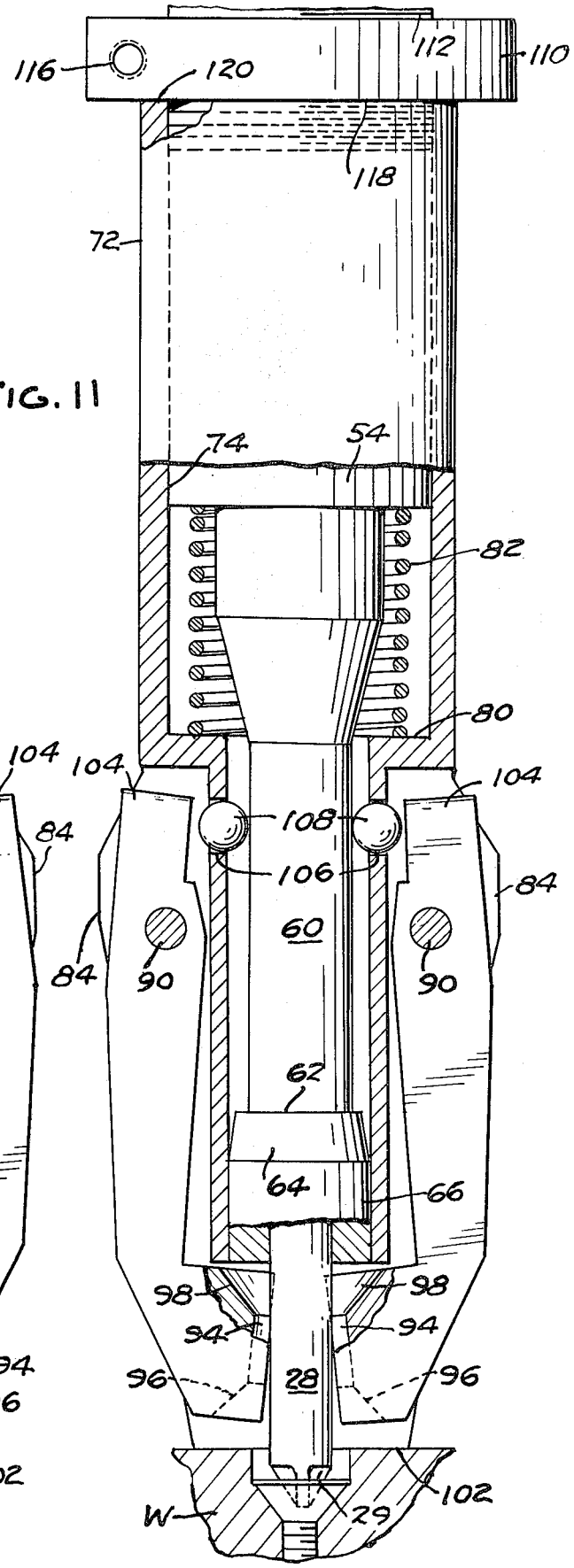
Figure 10:
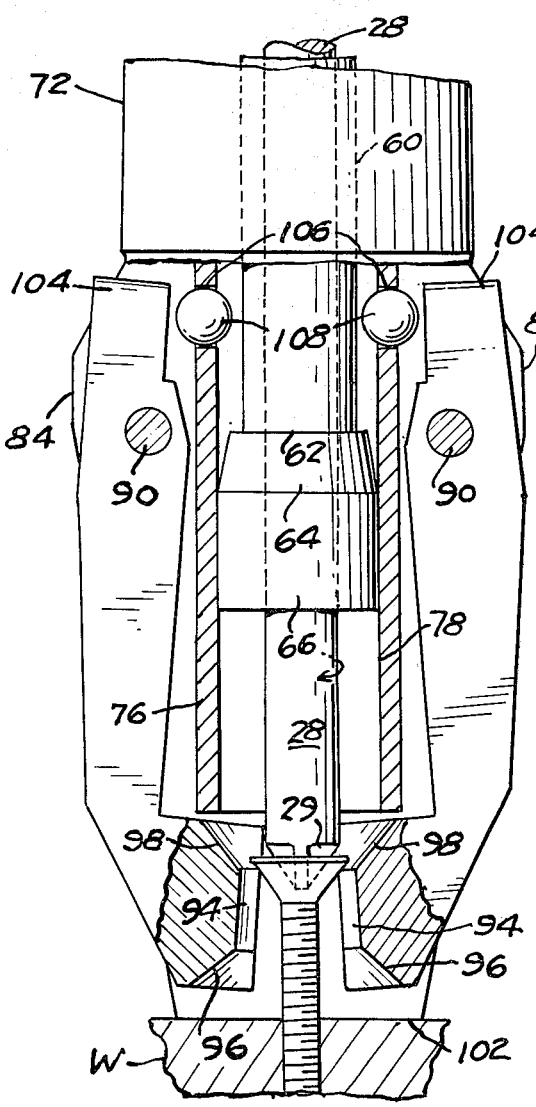

After the jaws are thus freed, the under side of the screw head engages and pushes against jaw surfaces 98 thereby camming the jaws toward open condition as illustrated in FIG. 10. The screw can be driven completely through the jaws and into the work as shown in FIG. 11. During the final range of screw driving movement, bit 29 and the lead portions of the shank of screw driver 28 project through the open jaws to the extent necessary to drive the screw into the work to the desired depth. Reduced diameter portion 60 of adapter 42 has sufficient axially length to enable balls 108 to remain at their radially inward positions in the entire range of the work stroke after shoulder 62 has cleared the balls.

When the work stroke has been completed and the tool is retracted from the work, spring 82 returns body 44 to the advanced position on adapter 42 shown in FIG. 1, and the tool is ready for the next cycle of operation.

During that part of the work stroke of the tool after advancement of body 44 is halted by engagement of surfaces 102 against the work, collar 110, following the movement of adapter 42, approaches shoulder 120 at the end of sleeve 70. When surface 118 of the collar engages shoulder 120, forward movement of adapter 42 and therefore of tool 20 and driver 28 is halted. This limits the extent of forward movement of driver 28 and the depth to which the screw is driven into the work. To adjust this depth, clamping screw 116 is turned to permit collar 110 to flex to loosened condition around tube 46. The collar can then be turned on its threads for movement axially toward or away from shoulder 120. Screw 116 is then retightened to constrict collar 110 around tube 46 for locking the collar in adjusted position.

During a work stroke, jaws 94 support the screw until a substantial portion of its length has been driven into the work, and it no longer requires support. In the structure illustrated, jaws 94 are considerably further from pivots 90 than are the points of engagement of balls 108 against extensions 104. Thus with only small radial movements of the extensions and balls 108, relatively large opening and closing movements of the jaws are obtained for accommodating relatively large screw heads. Jaws 94 are unblocked for receiving a screw head and are snapped into engagement around a screw shank by relatively slight axial movements of balls 108 back and forth over conical locking surface 64 and shoulder 62. This facilitates quick and easy loading of a screw into the nosepiece. Spring 82 is light enough to enable the operator manually to load screws into the nosepiece repeatedly without tiring.

It will be noted that in the structure disclosed, each jaw must swing open to accommodate one half of the diameter of the screw head. If the tool were to be used in close quarters it might be preferable to provide three or four jaws since each of then would then have to swing open to a lesser extent for passing a screw head. In such structures one ball 108 and cooperating lever extension 104 would be provided for each jaw.

The invention is not limited to use with a driver 28 having a bit 29. Sleeve portion 76 has a diameter great enought to accommodate, for example, a socket for driving an article having a square head, a hexagon head, or the like.

While the invention has been disclosed with reference to a screw driver, it is applicable in general to tools for driving any type of article having a head and a shank such as nails, rivets, bolts or headed studs. In addition to a rotating driver as disclosed herein, the invention is also applicable to tools utilizing percussive or reciprocating drivers as in nailers or riveters, or steady linear pressure drivers such as might be actuated by a hydraulic cylinder.

I claim:

1. For a tool having a housing which supports a driver for movement along an axis for driving an article of the type having a head and a shank toward a work piece, an article holding nosepiece which comprises, an adapter adapted to be mounted on the tool housing, a body supported for movement between advanced and retracted positions relative to said adapter, such movement being generally parallel to the direction of article-driving movement of the driver, means providing a bias which yieldably urges said body toward said advanced position, a plurality of jaws supported on said body for movement lateral of said direction between closed condition for holding an article shank in alignment with the driver and open condition for releasing the article shank, said adapter and body having means which cooperate to form blocking means effective in said advanced position to block movement of said jaws from said closed condition to said open condition, said body being movable against said bias toward said retracted position responsive to force applied thereto counter to said direction, said blocking means being effective to release said jaws for movement toward open condition responsive to attainment by said body of said retracted position, said jaws, upon release thereof, being movable to said open condition under the impetus of an article head pushed thereagainst either in said direction or in said counter direction, said body being returnable to said advanced position under said bias responsive to relief of said force, said blocking means being operable to return said jaws to said closed condition responsive to return of said body to said advanced position.

2. The structure defined in claim 1 wherein said blocking means constrains said body against detachment from said adapter under said bias.

3. The structure defined in claim 1 wherein said blocking means includes for each jaw an element carried by said body engaged against a portion of said adapter in said advanced position to so block movement of said jaws, said elements being disengaged from said adapter portion for so releasing said jaws responsive to attainment by said body of said retracted position.

4. The structure defined in claim 3 wherein said elements are movable lateral of said direction toward and away from the driver axis respectively for so releasing and returning said jaws.

5. The structure defined in claim 4 wherein said body has a wall with a plurality of openings therethrough, said elements being contained within and being so movable in said openings.

6. The structure defined in claim 5 wherein said elements comprise balls each being engaged at opposite sides by said adapter portion and a portion of a said jaw in said advanced position.

7. The structure defined in claim 6 wherein said adapter portion has relatively large diameter, said balls being aligned with a relatively smaller diameter portion of said adapter in said retracted position to facilitate said movement of said balls toward said driver axis.

8. The structure defined in claim 7 wherein said adapter has another portion with a diameter larger than that of the first-mentioned adapter portion, said balls being urged axially against said other portion by said bias but being restrained by said jaw portions against movement away from said driver axis to the diameter of said other portion, said balls by their engagement with said other adapter portion and jaw portions constraining said body against detachment from said adapter under said bias.

9. The structure defined in claim 6 wherein each jaw comprises a lever pivotally mounted on said body, each said jaw portion comprising one portion of the lever displaced in one direction from the pivotal mount, each lever having an article-holding portion displaced in the opposite direction from said mount.

10. The structure defined in claim 9 wherein said one lever portion is disposed closer to said pivotal mount than said article-holding portion.

11. The structure defined in claim 1 wherein said adapter has two axially spaced exterior surface portions which are slidably engaged by axially spaced interior surface portions of said body to facilitate said relative movements of said body and adapter.

12. The structure defined in claim 11 wherein said adapter has an end portion adapted so to be mounted on the tool housing, the slidably interengaged surface portions closer to said end portion having relatively larger diameter than that of the slidably interengaged surface portions further from said end portion, said adapter and body having axially spaced oppositely facing radial shoulders between the larger and small diameter surface portions, said bias comprising a spring axially compressed between the shoulders.

13. The structure defined in claim 12 wherein said blocking means comprises a third exterior surface portion of said adapter and elements carried by said body, said elements being engaged against said third surface portion when said body is in said advanced position, said elements being moved axially out of engagement with said third surface portion responsive to movement of said body to said retracted position.

14. The structure defined in claim 13 wherein said elements are radially movable on said body, said adapter having a fourth surface portion adjacent to and having a different diameter than said third surface portion with which said elements align radially with upon retraction of said body to so release said jaws.

15. The structure defined in claim 14 wherein said fourth surface portion has a diameter smaller than said third surface portion.

16. The structure defined in claim 15 wherein said third surface portion adjoins that one of said two surface portions of said adapter having the smaller diameter, said third surface portion, progressing toward said fourth surface portion, tapering to a smaller diameter.

17. The structure defined in claim 16 wherein said body has a substantially cylindrical tubular wall which provides the smaller diameter of said interior surface portions, said wall having for each jaw an opening therethrough, each said element comprising a ball having a diameter greater than the thickness of said wall, each ball being radially movably carried within a said opening, each ball in said advanced position of said body having a radially outer portion which engages a said jaw and a radially inner portion which engages said third surface portion of said adapter.

18. The structure defined in claim 17 wherein each jaw comprises a lever pivotally mounted on said body, each jaw having one portion displaced in one direction from the pivotal mount and being so engaged by a ball, each lever having an article-holding portion displaced in the opposite direction from said mount.

19. The structure defined in claim 18 wherein said one lever portion is disposed closer to said pivotal mount than said article-holding portion.

20. The structure defined in claim 1 wherein said adapter has one end portion adapted to be mounted on the tool housing and another end portion axially remote from said one end portion, said adapter, progressing from said one end portion toward said other end portion, having a first cylindrical portion of relatively large diameter which terminates at a radially inward shoulder, an intermediate portion of reduced diameter, an outwardly tapering conical portion and a second cylindrical portion of relatively smaller diameter than said first cylindrical portion, said body having a sleeve with first and second portions dimensioned respectively to engage axially slidably around said first and second cylindrical portions to facilitate said relative movements of said body and adapter, and a radial shoulder between said sleeve portions, said bias being provided by a coil spring compressed between said shoulders, said body having mounting lugs disposed radially outwardly of said second sleeve portion, said jaws comprising levers pivotally mounted on said lugs, each lever having an article-holding portion which extends from its pivotal mount away from said first sleeve portion, each lever having an extension projecting from its pivotal mount toward said first sleeve portion and being disposed radially outwardly of said conical portion, said second sleeve portion having a radial opening therethrough aligned between each said extension and said conical portion, said blocking means comprising a ball carried within and radially movable within each opening, each ball in said advanced position of said body having a radially outer portion which engages a said extension and a radially inner portion which engages a point on said conical portion between the smaller and larger diameter ends thereof, said balls responsive to movement of said body to said retracted position being aligned with said adapter portion of reduced diameter to facilitate radially inward movement of said balls for so releasing said jaws, said conical portion responsive to return of said body to said advanced position being effective to force said balls radially outwardly to effect return of said jaws to said closed condition, said extensions in closed condition of said jaws being effective to block radially outward movement of said balls to said larger diameter of said conical portion under the axial thrust of said bias to restrain detachment of said body from said adapter under said bias.

21. The structure defined in claim 20 wherein said cylindrical portions and sleeve portions have a range of relative movement additional to that in which said body moves from said advanced position to said retracted position to facilitate movement of said adapter with a driver toward a work piece after said jaws have been moved to opened condition and independently of said body, said intermediate portion of said adapter having a length adequate to facilitate said additional range of movement.

22. The structure defined in claim 21 wherein said intermediate portion is cylindrical.

23. The structure defined in claim 22 wherein said jaws are two in number and are disposed adjacent diametrically opposite sides of said second sleeve portion.

24. The structure defined in claim 23 wherein said jaws in closed condition have article-holding surfaces closely adjacent the end of said second sleeve portion remote from said first sleeve portion.

25. The structure defined in claim 1 wherein said body and adapter have a range of relative movement additional to that in which said body moves from said advanced position to said retracted position to facilitate movement of said adapter independently of said body after said jaws have been moved to open condition for advancing an article toward a work piece, said body and adapter having exterior portions which close relative to each other responsive to said relative movement in said additional range, and means providing said exterior portions with an obstruction which limits said movement in said additional range for limiting the stroke of a driver toward a work piece.

26. The structure defined in claim 25 wherein said obstruction comprises a collar around one of said exterior portions engagable with a shoulder on the other exterior portion.

27. The structure defined in claim 26 wherein said collar is threaded onto said one exterior portion, said collar being axially adjustably positioned on said one exterior portion by turning the same on its threading.

28. The structure defined in claim 27 wherein said collar is split to facilitate radial flexing thereof, said collar having circumferentially spaced apart portions bridged by a clamping screw to tighten said collar in adjusted position.

29. The structure defined in claim 28 wherein said adapter has a cylindrical portion adjacent an end portion which is adapted to be mounted on the tool, said cylindrical portion providing said one exterior portion, said body having a sleeve which slidably surrounds said cylindrical portion, said shoulder comprising an end of said sleeve.

30. In combination an article-driving tool and a nosepiece as defined in claim 1 mounted thereon.

31. In combination an article-driving tool and a nosepiece as defined in claim 10 mounted thereon.

32. In combination an article-driving tool and a nosepiece as defined in claim 18 mounted thereon.

33. In combination an article-driving tool and a nosepiece as defined in claim 20 mounted thereon.

34. In combination an article-driving tool and a nosepiece as defined in claim 25 mounted thereon.

35. In combination an article-driving tool and a nosepiece as defined in claim 29 mounted thereon.

* * * * *